United States Patent [19]

Renger et al.

[11] Patent Number: 4,655,720

[45] Date of Patent: Apr. 7, 1987

[54] TOY GLIDER

[75] Inventors: Larry H. Renger, Hawaiian Gardens; Raymond J. Gross, Culver City, both of Calif.

[73] Assignee: Mattel, Inc., Hawthorne, Calif.

[21] Appl. No.: 752,285

[22] Filed: Jul. 5, 1985

[51] Int. Cl.[4] ..... A63H 27/00

[52] U.S. Cl. ..... 446/61; 446/68

[58] Field of Search ..... 446/55, 56, 57, 58, 446/59, 60, 61–66, 68

[56] References Cited

U.S. PATENT DOCUMENTS

| | | | |
|---|---|---|---|
| 2,145,972 | 2/1939 | Clark et al. | 46/81 |
| 2,538,522 | 1/1951 | Jackle | 46/80 |
| 2,724,211 | 11/1955 | Bloom | 446/66 |
| 2,739,414 | 3/1956 | Cleveland | 446/66 |
| 2,896,370 | 7/1959 | DeWitt | 446/61 |
| 2,932,124 | 4/1960 | Robinette | 446/61 |
| 3,022,966 | 2/1962 | Briggs | 446/61 X |
| 3,177,612 | 4/1965 | Giossi | 446/64 |
| 3,286,957 | 11/1966 | Libbey | 244/16 |
| 3,564,758 | 2/1971 | Willis | 446/116 |
| 3,619,937 | 11/1971 | Thompson et al. | 46/76 |
| 3,787,998 | 1/1974 | Kilroy, Jr. et al. | 47/79 |
| 3,827,177 | 8/1974 | Wengel | 446/112 |
| 3,898,763 | 8/1975 | Rizzo | 46/79 |
| 4,033,070 | 7/1977 | Strongin et al. | 46/79 |
| 4,064,647 | 12/1977 | Lemelson | 46/81 |
| 4,109,411 | 8/1978 | Wetherell et al. | 46/79 |
| 4,324,064 | 4/1982 | Bettencourt et al. | 446/64 |
| 4,411,249 | 10/1983 | Fogarty et al. | 124/64 |
| 4,458,442 | 7/1984 | McDaniel | 446/66 |
| 4,494,940 | 1/1985 | Gretz | 446/61 |

FOREIGN PATENT DOCUMENTS

| | | | |
|---|---|---|---|
| 605141 | 7/1948 | United Kingdom | 446/56 |

*Primary Examiner*—Mickey Yu

*Attorney, Agent, or Firm*—Ronald M. Goldman; Melvin A. Klein; John Mesaros

[57] ABSTRACT

A toy glider having a generally rigid spine member with integrally formed transversely extending connector portions configured for receiving the wings therein, with the wings being separable from the spine member on impact. The wings are provided with creases with apertures adjacent thereto for connecting thereto simulated armament which maintains each wing in a folded configuration, with a seat member being adjustably attachable to the spine member, the seat being adapted for receiving one of a plurality of toy figures of different weights within a range of weights, the position of the seat and the weight of the figure, in part, controlling the aerodynamics of the glider.

18 Claims, 9 Drawing Figures

18a
18
18b
18c
18d
18e
18f
18g
20d
20b
20
20d
14
30
24
24a
31
12b
15
25a
42
32
26
26a
33
5
5
12a
24a
40
44
25a
26a
16b
16c
16d
16e
16f
16g
16
22a
17
16a
22b 23a
23b
23c
23d
19
18
9
12
12a
12b
25
40
42
44
20a
20b
20c
20d
21
24
31
32

TOY GLIDER

BACKGROUND OF THE INVENTION

The background of the invention will be discussed in two parts:

Field of the Invention

This invention relates to toy airplanes, and more particularly to unpowered toy gliders.

Description of the Prior Art

Toy airplanes have been a source of amusement for decades, particularly the types of unpowered toy airplanes which are propelled by throwing, with the airplane performing loops and dives, depending on the twisting of the wings, tails and ailerons, or combinations thereof. At the outset, such airplanes were made of paper or balsa wood, but in more recent years, lightweight synthetic materials such as styrofoam and plastic have been employed.

On such early glider is shown and described in U.S. Pat. No. 2,145,972, issued Feb. 7, 1939 to Clark, et al, for an "Aerial Toy", in which a stick-like body formed of wood, or the like, is provided with a metal bracket at the nose end thereof with wings pivotally attached thereto.

Another such airplane is shown and described in U.S. Pat. No. 2,538,522, entitled "Toy Glider" issued to Jackle on Jan. 16, 1951, the glider being provided with a cigar-shaped fuselage with wings foldably attached thereto.

U.S. Pat. No. 3,286,957, directed to "Flexible Wing Deployment Device", was issued to Libbey on Nov. 22, 1966, and illustrates an aerial device having a superstructure formed of a plurality of tubular telescoping members with the wing portion formed of a cloth-like material, the unit being extended by means of a drogue parachute, while in flight.

U.S. Pat. No. 3,619,937, entitled "Space Glider", issued to Thompson, et al, on Nov. 16, 1971, such patent disclosing a vacuum-formed plastic airplane, with a figure-holding recess near the front for holding a removable toy figure, with the recessed undersurface providing means for holding the glider for manually launching the same.

Another "Gliding Toy" is shown and described in U.S. Pat. No. 3,787,998, issued to Kilroy, Jr. et al, on Jan. 29, 1974, the toy being a combination kite and glider in the form of a bird with heavy legs and a clip attached to the front thereof for releasing the bird from a tether string by a sudden jerk.

Another such unpowered airplane is shown in U.S. Pat. No. 3,898,763, issued Aug. 12, 1975, to Rizzo, for a "Model Aircraft", the patent disclosing a molded styrofoam toy aircraft with a delta wing configuration, and a wooden dowel embedded in the nose pod and extended into the wing for establishing the center of gravity.

U.S. Pat. No. 4,033,070, issued to Strongin et al, on July 5, 1977, entitled "Toy Foam Glider", the glider having the fuselage, wing and rudder made of flexible resilient foam with the wing passed through a slot in the fuselage, and the rudder positioned in a notch on the trailing edge of the craft.

U.S. Pat. No. 4,064,647, entitled "Catapult Launched Model Glider", issued to Lemelson, on Dec. 27, 1977, and discloses a glider formed of lightweight cellular plastic with a rigid hook portion embedded in the undersurface adjacent the nose for receiving a loop from an elastic band attached to the launcher for propelling the craft.

A "Toy Figure Glider" is shown and described in U.S. Pat. No. 4,109,411, issued to Wetherell, et al, on Aug. 29, 1978. In this patent, the toy is configured to resemble the shape of a human with pivotable arm portions, with the wing portion being attachable to the body portion by a mounting rod which provides the pivot connection for the arms.

Another toy airplane is shown and described in U.S. Pat. No. 4,411,249, issued Oct. 25, 1983, to Fogarty et al, the patent being entitled "Toy Glider With Pneumatic Launcher". The launcher is shaped in the form of a bracelet for wearing, with an air bulb connected to a tubular member providing the propulsion force for a glider having a main body portion including a closed end tube positionable over the launcher tube.

A "Glider With Adjustable Wings" is shown and described in U.S. Pat. No. 4,458,442, issued July 10, 1984 to McDaniel. The body and wing are formed of generally planar material which is foldable, with the body having arcuate notches for receiving and retaining the wing.

It is an object of the present invention to provide a new and improved toy glider.

It is another object of the present invention to provide a new and improved toy glider configured for carrying toy figures, and the like.

It is a further object of the present invention to provide a new and improved toy glider having a delta wing configuration having generally rigid spine member support for minimizing damage thereto.

It is a still further object of the present invention to provide a new and improved toy glider with first and second wing members attached to a body portion with provision for detachment of the wings upon impact to minimize breakage.

It is still another object of the present invention to provide a new and improved relatively large toy glider having a folded delta wing configuration, with the wings therof formed of styrofoam.

SUMMARY OF THE INVENTION

The foregoing and other objects are accomplished by providing a toy glider having a generally rigid somewhat flexible spine member with integrally formed transversely extending connector portions configured for receiving the wings therein, with the wings being separable from the spine member on impact. The wings are provided with creases and apertures for connecting thereto simulated armament. The interconnection of the components of the simulated armament on the crease maintain the wings in a folded configuration along the crease. A seat member is adjustably attachable to the spine member, the seat being adapted for receiving one of a plurality of toy figures of different weights, the position of the seat and the weight of the figure, in part, controlling the aerodynamics of the glider.

Other objects, features and advantages of the invention will become apparent from a reading of the specification, when taken in conjunction with the drawings, in which like reference numerals refer to like elements in the several views.

DESCRIPTION OF THE PREFERRED EMBODIMENT

Figure 1:
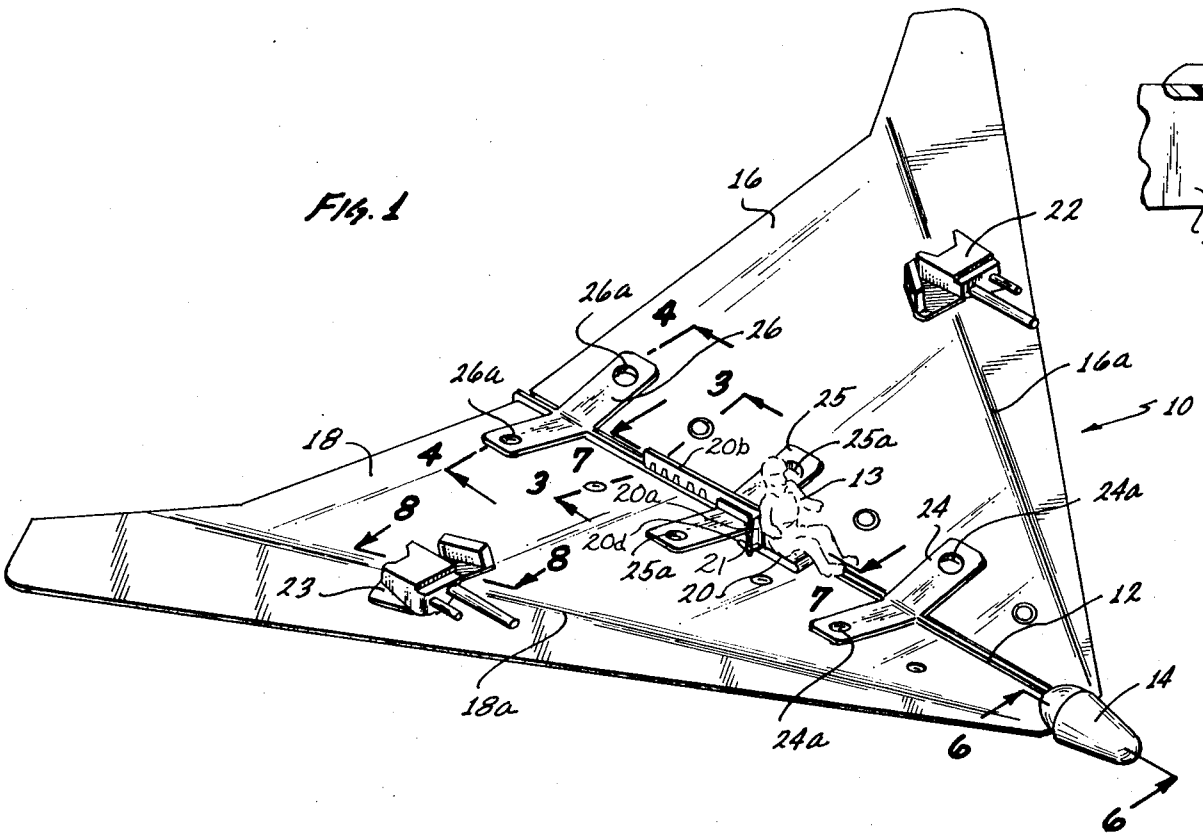
FIG. 1 is a perspective view of the toy glider in accordance with the present invention.
Figure 2:
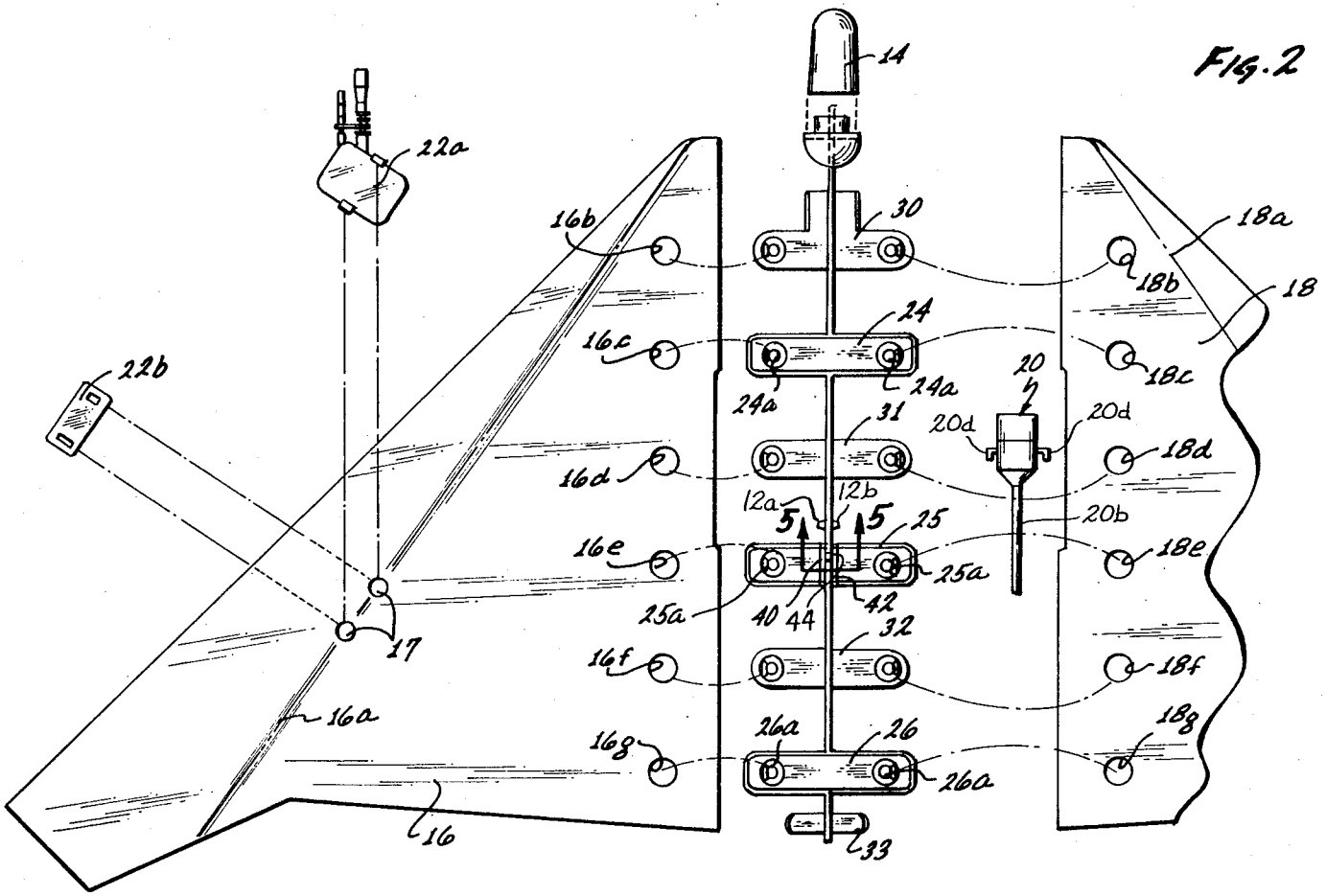
FIG. 2 is an exploded plan view, partially broken away, of the toy glider of FIG. 1.

Referring now to the drawings, and particularly to FIGS. 1 and 2, there is shown a toy glider, generally designated 10, having a main body or spine portion 12, a figure toy 13 attachable thereto, a nose member 14 attached to the front end of the spine member 12, first and second wing members 16 and 18 attachable to the spine member 12, a generally centrally disposed seat member 20 adjustably attachable to the spine member 12, and first and second simulated accessory device assemblies 22 and 23 attachable to the wings 16 and 18.

The spine member 12 is formed in one piece, such as by molding, of a generally rigid somewhat resilient material such as high impact polyestyrene plastic material, while the wing members 16 and 18 are formed of an expanded or cellular foam composition such as styrofoam. As assembled, the wings 16 and 18 are in the form of a delta wing or "Rogallo" wing, with angularly disposed longitudinally extending creases **16*a* and 18*a* being provided for angling the outer longitudinal edges of the wings 16 and 18 downwardly. Along each of the creases 16*a* and 18*a*, two pairs of aligned apertures 17 and 19, respectively, are formed along the respective crease for receiving the accessory device assemblies 22 and 23**, which, as will hereinafter be explained, assist in maintaining the wing bend at a fixed angle.

Figure 3:
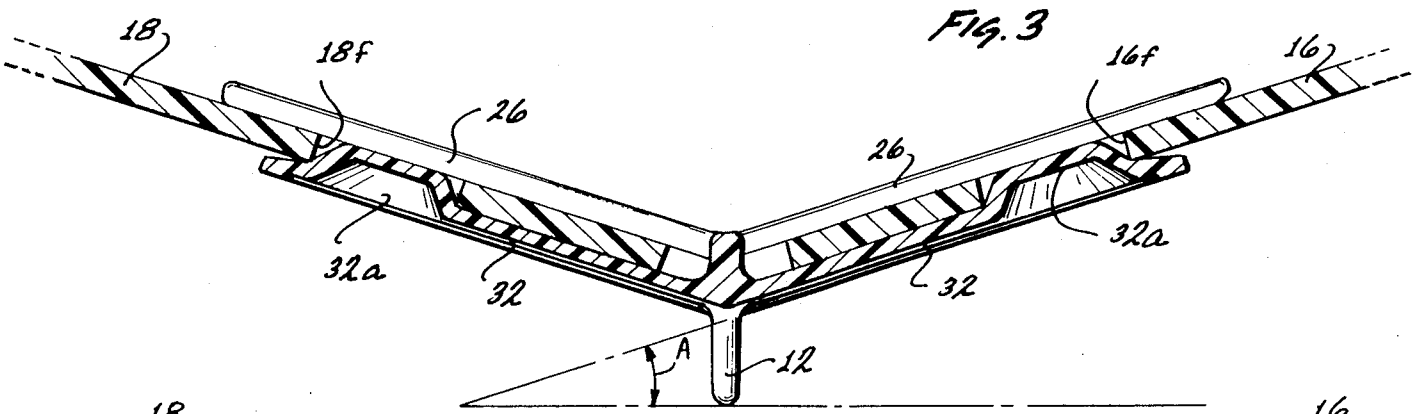
FIG. 3 is a partial cross-sectional view of the toy glider of FIG. 1 as viewed generally along line 3—3 thereof to illustrate the interconnection of the wings to the spine member.
Figure 4:
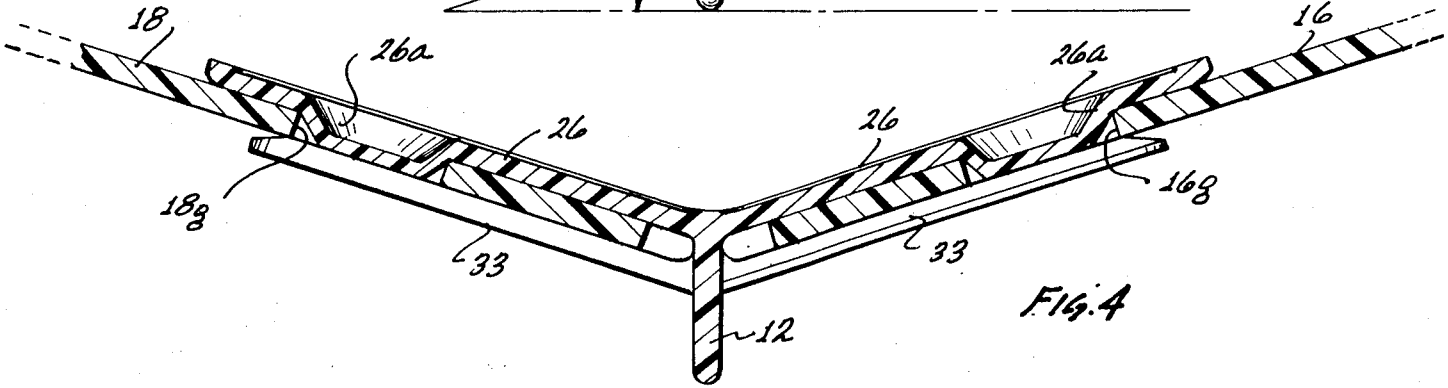
FIG. 4 is a partial cross-sectional view of the toy glider of FIG. 1 as viewed generally along line 4—4 thereof to illustrate the interconnection of the wings to the spine member.

As better illustrated in FIGS. 2–4, the spine member 12 has formed integrally therewith a first set of a plurality of transversely extending aligned pairs 24–26 of upper rib members and a like second set of a plurality of transversely extending aligned pairs of lower rib members 30–33, the upper and lower rib pairs being longitudinally offset along the length of the spine portion 12. To facilitate insertion of the wings 16 and 18, the lower set of rib members 30–33 are shorter than the upper pairs 24–26. The main body portion of the spine member 12 is generally bar-shaped with an upper edge and a lower edge with the distance between rib sets slightly less than the thickness of the wings 16 and 18 to allow a slight preload for gripping of the wings 16 and 18.

For interconnection of the wings 16 and 18 to the spine member 12, the outer edges of the ribs are provided with detent or dimple means while the wings are provided with apertures for engaging the dimples. Specifically, each of the rib pairs 24–26 is provided adjacent the outer end thereof with a downwardly depending dimple **24*a*–26*a*, with each rib of the rib pairs 30–32 provided adjacent the outer end thereof with an upwardly extending dimple 30*a*–32*a*, with all of the dimples on each side of the spine member 12 being in generally longitudinal alignment for coacting with the longitudinally aligned recess means or apertures 16*b*–16*g* in wing 16 and the similar longitudinally aligned apertures 18*b*–18*g* in wing 18, each row of apertures being generally parallel to the adjacent connecting edge of the respective wing 16 and 18. Each of the dimples 24*a*–26*a* and 30*a*–32*a* has a frusto-conical cross-section, that is the dimples are beveled in such a way as to provide ease of insertion of the wings 16 and 18**, while providing good retention.

The terms "upper" and "lower", and other words of similar import, as used herein are intended to refer to the respective direction with the glider 10 in its normal flight position depicted in FIG. 1, and are intended to facilitate description of the preferred embodiment, and are not intended to be construed as words of limitations.

As shown also in FIGS. 3 and 4, the upper rib pairs 24–26 are generally V-shaped in front elevation, as are the lower rib pairs 30–33. Along each side of the spine member 12, the ribs of the upper rib pairs 24–26 lie in a common plane displaced from the common plane of the ribs of the lower rib pairs 30–33. This displacement between these common planes is slightly less than the width or thickness of the wing members 16 and 18 to facilitate gripping and retention after insertion. For attachment of the wings 16 and 18 to the spine member 12, the edge of each of the wings alternately engages first an upper rib and then a lower rib, with the dimples of each of the ribs coacting within an aperture of the wing 16 or 18. With this interconnection, in the event of impact of the wing with an object, the corresponding impacted wing 16 or 18 will break away from the spine member 12, thus minimizing the possibility of breakage of the impacted wing.

FIGS. 3 and 4 depict the details of the attachment of the wings 16 and 18 to the spine member 12, and, as can be seen in FIG. 3, the dimples **32*a* of lower ribs 32 are generally frusto-conically configured relative to the apertures 16*f* and 18*f* to facilitate wing insertion on assembly and wing separation on impact. Similarly, as can be seen in FIG. 4, the depending dimples 26*a* of upper ribs 26 are frusto-conically configured for being received in the apertures 16*g* and 18*g* of wings 16 and 18**, respectively.

Figures 5, 7, 8, 9:
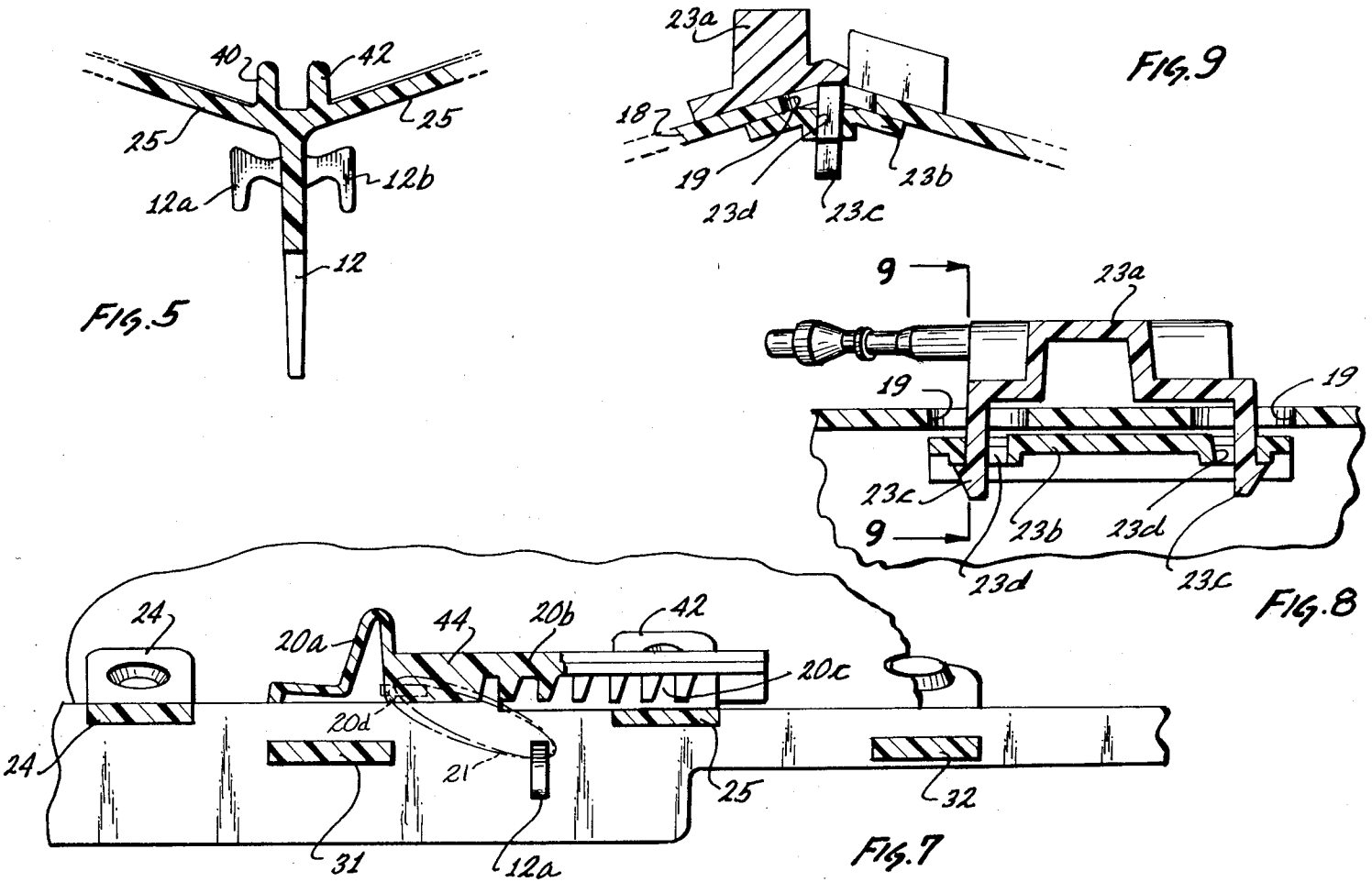
FIG. 5 is a partial cross-sectional view of the spine member of the toy glider of FIG. 2 as viewed generally along line 5—5 thereof to illustrate the seat connection portion.
FIG. 7 is a partial cross-sectional side view of the spine member of the toy glider of FIG. 1 as viewed generally along line 7—7 thereof to illustrate the interconnection of the seat member to the spine member.
FIG. 8 is a partial cross-sectional view of the toy glider of FIG. 1, taken generally along line 8—8 thereof depicting the interconnection of accessory components to the wing.
FIG. 9 is a partial cross-sectional view of the accessory assembly of FIG. 8, as viewed generally along line 9—9 thereof.

Referring now to FIGS. 1, 5 and 7, the seat member 20 has a seat portion **20*a* and a rearwardly extending bar-shaped portion 20*b* with a notched lower edge 20*c* (See FIG. 7), the bar portion 20*b* having a thickness sufficient for being loosely received between upwardly extending spaced tabs 40 and 42 (See also FIG. 3) formed integrally with the spine member 12. One of the notches is positioned over and engaged by a third upwardly extending tab 44 formed integrally with and extending transversely to the spine member 12. The seat member 20, along with the figure toy 13 seated thereon may thus be positioned along a limited length of the spine member 12 to adjust the flying characteristics of the glider 10. To facilitate securing the seat member 20 to the spine member 12, the spine member 12 is provided with hook members 12***a* and 12*b* (See FIGS. 1, 2 5 and 7) which may be used to secure the loops of an elastic band 21 about the hooks 20*d* of the seat member 20. This elastic band 21 on the seat member 20 allows for easy adjustment but secures the seat member 20 for normal flight, while absorbing impact.

Figure 6:
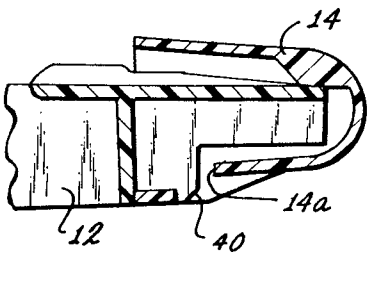
FIG. 6 is a partial cross-sectional view of the nose portion of the toy glider of FIG. 1 as viewed generally along line 6—6 thereof.

For the purpose of providing protection to the nose portion on impact, the forward portion of the glider 10 is provided with a nose member 14, formed of a high impact somewhat resilient material, and, as shown in FIG. 6, the nose member 10 is generally bulb-shaped with a depending portion having a slot 14*a* therein for interconnection with a depending tang 40 formed on the spine member 12 at the forward end thereof. The nose member 10 is formed such as by molding of a plastic material with a thickness consistent with the strength and weight desired.

For enabling retention of the wings 16 and 18 folded in a downwardly depending manner along the creases 16*a* and 18*a*, the accessory device assemblies 22 and 23 are configured for placement on the creases 16*a* and 18*a*, while retaining the desired bend angle. Referring to FIGS. 8 and 9, one of the assemblies 23 is shown and consists of an upper part 23*a* with an inverted V-shaped bottom surface, and a lower part 23*b* with a mating V-shaped configuration. The part 23*a* is provided with a pair of depending generally identically configured tangs 23*c*, configured for snap fitting engagement within the slots 23*d* formed in the lower part 23*b* after passage of the tangs 23*c* through the aligned pair of apertures 19 formed in wing 18 along the crease 18*a* (See also FIG. 2). The accessory device assemblies 22 and 23 of the glider 10 are configured to simulate futuristic space weapons such as laser cannons.

The length and location of the creases 16*a* and 18*a* in the delta wing configuration of the wings 16 and 18 provide several advantages. Initially, in length along the spine member 12, the wings 16 and 18 extend approximately one foot in length with a total assembled wing span of approximately twenty-five inches. With such a large wing surface formed in a styrofoam material, without such creases 16*a* and 18*a*, warping and curling of the finished wing would result. Thus the creases 16*a* and 18*a* enable the glider 10 to be manufacturable, that is a glider with a relatively large wing surface may be made. Additionally, with the wing fold retaining assemblies 22 and 23 in position along the creases 16*a* and 18*a*, the final configuration of the wings 16 and 18 provides both lateral and longitudinal stability for the glider 10 without separate vertical or horizontal stabilizing surfaces. To assist in crash resistance, a strip of tape (not shown) may be affixed to the leading edges of each of the wings 16 and 18 to toughen the wing edges. In this manner, the wing and fold characteristics provide a certain amount of shock absorption on impact while the tape strengthens the wing edges.

Referring to FIG. 2, with respect to wing 16, the length of the connecting edge adjacent spine member 12 is appoximately one foot, with the angle between this edge and the leading or outer edge of the wing 16 being approximately forty-five degrees. The angle between the outer or leading edge of the wing 16 and the crease 16*a* is approximately fifteen degrees, with the crease dividing the wing surface into a first, or major wing portion, and a second, or minor wing portion. The area of the wing 16 within the angle between the outer edge thereof and the crease 16*a* essentially forms the second, or minor wing portion with rearwardly extending wing tips. It is to be understood that wing 18 is identically configured in mirror image relation to wing 16.

While the exact angles of the wings 16 and 18 relative to a horizontal plane (as viewed in FIGS. 3 and 4), and the angles of the two wing portions formed along the creases 16*a* and 18*a* (as viewed in FIG. 9) are empirically determined, in the embodiment shown, each wing 16 and 18 is disposed at an angle A of approximately twenty degrees from a plane drawn perpendicular to the plane of the spine member 12, that is twenty degrees from a horizontal plane drawn through and including the lower edge of the spine member 12. With the assemblies 22 and 23 secured to the wings 16 and 18, by reference to FIG. 9, the angle B of each wing portion relative to the longitudinal centerline of tang 23*c* is about thirty degrees. It has been found that there is an interaction among the various sizes and angles of the components of the glider 10, such as the location of the center of gravity of the glider 10, the configurations of the wings 16 and 18, the angles of the wings 16 and 18 relative to the spine member 12, and the angles of the two portions of each wing relative to the other. With the embodiment shown, the angle of the wings 16 and 18 relative to a horizontal plane may lie in the range of fifteen to twenty-five degrees, and the angle of the wing portions relative to the centerline of tang 23*c* may lie in the range of twenty to forty degrees.

In accordance with the invention, the glider 10 is provided with a generally rigid somewhat resilient spine member 12 with laterally extending alternating upper and lower rib pairs with dimples therein for engagement of apertures formed in the wings for facilitating assembly while enabling wing detachment upon impact. The adjustably positionable seat member 20 along with the selection of a figure toy 13 of a different weight enables adjusting the aerodynamic characteristics of the glider 10, while the delta wing configuration with downwardly depending edges enables the carrying by the glider of a toy FIG. 13 of considerable weight and mass relative to the size of the glider 10. Although only one figure toy 13 has been depicted, it is to be understood that other figure toys of similar sizes and different weights may be utilized to, in part, along with the adjustment of the position of the seat, control the aerodynamics of the glider 10. In practice, the weight of the different figure toys 13 which may be attached to the glider 10 lies in the range of 2:1.

While there has been shown and described a preferred embodiment, it is to be understood that various other adaptations and modifications may be made within the spirit and scope of the invention.

We claim:

1. In a toy glider, the combination comprising:

first and second wing members, each having a longitudinal connecting edge;

a row of recess means in each of said wing members spaced from said longitudinal edge; and a generally bar-shaped spine member having a length slightly greater than the length of said longitudinal connecting edge and having integrally formed transversely extending rib means having detent means formed therein for engagement with said recess means, said rib means including a plurality of pairs of aligned ribs oppositely extending from the longitudinal centerline of said spine menber, the coaction of said rib means and said recess means receiving said longitudinal edges of said wing members for retaining said wing members on said spine member, said recess means and said rib means being configured, dimensioned and arranged for enabling detachment of a wing member upon impact with an object.

2. The combination according to claim 1 wherein said detent means are dimples.

3. The combination according to claim 2 wherein said rib means includes first and second sets of rib pairs in spaced relation for receiving said wing members therebetween.

4. The combination according to claim 3 wherein said recess means are apertures.

5. The combination according to claim 4 wherein at least one of the rib pairs of said first set are longitudinally offset from the rib pairs of said second set.

6. The combination according to claim 5 further including seat means attachable to said spine member for retaining a figure toy thereon.

7. In a toy glider, the combination comprising:

first and second wing members configured, when assembled, to form a delta wing configuration;

a main spine member;

mating coacting means on said spine member and said wing members for enabling fastening said wing members to said spine member, said coacting means being configured for permitting detachment of a wing member upon impact of said wing member with an object;

seat means for receiving a figure toy thereon; and means on said spine member for adjustably positioning said seat means thereon.

8. The combination according to claim 7 wherein said coacting means includes transversely extending rib means formed integrally with said spine member, said rib means having detent means formed thereon, and said wing members including recess means for engagement by said detent means.

9. The combination according to claim 8 wherein said wing members have generally longitudinally extending creases, and said glider includes means attachable to said wing members on said creases for maintaining the outer edges of said wing members at an angle relative to the plane of the balance of the wing members.

10. The combination according to claim 9 wherein said means attachable to said wing members are simulated armament.

11. The combination according to claim 9 wherein said means attachable to said wing members includes first and second generally similar assemblies, each of said assemblies including a first part having a generally V-shaped bottom surface for engaging the upper wing surface at said crease, and a second part having a generally mating upper surface with one of said parts having tang members for passage through aligned apertures in said wing on said crease, and the other of said parts having slots therein for receiving and retaining said tang members with said second part on the opposite surface of said wing member.

12. The combination according to claim 8 wherein said detent means are dimples.

13. The combination according to claim 8 wherein said rib means includes a plurality of pairs of aligned ribs oppositely extending from the longitudinal centerline of said spine member in a direction transverse thereto.

14. The combination according to claim 8 wherein said rib means includes first and second sets of rib pairs in spaced relation for receiving wing members therebetween.

15. The combination according to claim 14 wherein said recess means are apertures.

16. The combination according to claim 15 wherein at least one of the rib pairs of said first set are longitudinally offset from at least some of the rib pairs of said second set.

17. In a toy glider, the combination comprising:

first and second wing members configured, when assembled, to form a delta wing configuration, each of said wing members being formed of a plastic material;

a main spine member;

mating coacting means on said spine member and said wing members for enabling fastening said wing members to said spine member at an angle to a horizontal plane containing the lower spine edge, said coacting means being configured for permitting detachment of a wing member upon impact of said wing member with an object;

a generally longitudinally extending crease on each of said first and second wing members; and means attachable to each of said wing members along said crease for maintaining an inverted generally V-shaped fold in the outer edge of said wing members.

18. The combination according to claim 17 wherein said wing members extend upwardly at an angle to a horizontal plane of between fifteen and twenty-five degrees and said V-shaped folds form an angle of between forty and eighty degrees.

* * * * *